US010731394B2

(12) United States Patent
Emrich

(10) Patent No.: US 10,731,394 B2
(45) Date of Patent: Aug. 4, 2020

(54) TWO-SIDED DOOR USAGE SAFETY SYSTEM

(71) Applicant: Dan Emrich, Irvine, CA (US)

(72) Inventor: Dan Emrich, Irvine, CA (US)

( * ) Notice: Subject to any disclaimer, the term of this patent is extended or adjusted under 35 U.S.C. 154(b) by 147 days.

(21) Appl. No.: 16/039,804

(22) Filed: Jul. 19, 2018

(65) Prior Publication Data

US 2020/0024882 A1 Jan. 23, 2020

(51) Int. Cl.

| | |
|---|---|
| ***E06B 7/00*** | (2006.01) |
| ***E05F 15/43*** | (2015.01) |
| ***F21V 23/04*** | (2006.01) |
| *F21S 9/02* | (2006.01) |

(52) U.S. Cl.

CPC ..... *E05F 15/43* (2015.01); *F21V 23/0471* (2013.01); *E05F 2015/434* (2015.01); *E05Y 2400/44* (2013.01); *E05Y 2900/132* (2013.01); *F21S 9/02* (2013.01)

(58) Field of Classification Search

CPC ..... E05F 15/43; E05F 2015/434; F21V 23/0471; F21S 9/02; E05Y 2400/44; E05Y 2900/132

USPC ..... 49/25, 70, 171

See application file for complete search history.

(56) References Cited

U.S. PATENT DOCUMENTS

| | | | | | |
|---|---|---|---|---|---|
| 177,432 | A * | 5/1876 | Smith | E06B 7/30 | 49/171 |
| 2,169,874 | A * | 8/1939 | Hardt | E06B 7/30 | 359/504 |
| 2,229,594 | A * | 1/1941 | Seiler | E06B 7/30 | 359/629 |
| 2,638,810 | A * | 5/1953 | Berleme | E06B 7/30 | 359/504 |
| 5,161,328 | A * | 11/1992 | Traue | E06B 7/30 | 49/171 |
| 5,671,564 | A * | 9/1997 | Lyle | E06B 7/30 | 49/171 |
| 6,006,474 | A * | 12/1999 | Stocksmeier | E06B 7/30 | 49/171 |
| D419,529 | S | 1/2000 | Nicodemus | | |
| 6,967,587 | B2 | 11/2005 | Snell et al. | | |
| 7,552,554 | B1 * | 6/2009 | Marquardt | E06B 7/28 | 40/493 |
| 8,402,693 | B1 * | 3/2013 | Trefzer | E06B 9/0638 | 49/169 |

(Continued)

FOREIGN PATENT DOCUMENTS

| | | |
|---|---|---|
| WO | WO2011115830 | 9/2011 |

*Primary Examiner* — Jerry E Redman

(57) ABSTRACT

A two-sided door usage safety system for preventing door related injuries includes a housing having a front end and a rear end each having a first engagement mechanism. The housing is configured to fit through a sensor aperture in a door. A pair of motion sensors and a pair of LED indicators are coupled within the front end and the rear end. A logic chip and a battery are coupled within an inner cavity of the housing. Each of a pair of face plates has a central viewing window and a second engagement mechanism that is selectively engageable with the first engagement mechanism. The pair of motion sensors and the logic chip are configured to detect when two people are simultaneously approaching the door from either side and to illuminate the pair of LED indicators to warn the people to open the door with caution.

9 Claims, 4 Drawing Sheets

(56) References Cited

U.S. PATENT DOCUMENTS

| | | | | |
|---|---|---|---|---|
| 8,823,529 | B2 | 9/2014 | Reed, Jr. | |
| 9,163,446 | B2 | 10/2015 | Houser | |
| 2011/0227746 | A1* | 9/2011 | Houser | E05F 3/22 340/686.1 |
| 2015/0285489 | A1 | 10/2015 | Ulysse | |
| 2015/0379792 | A1* | 12/2015 | Frank | G07C 9/37 49/25 |
| 2016/0353542 | A1 | 12/2016 | Orr | |
| 2018/0320412 | A1* | 11/2018 | Matosian | E05B 49/00 |
| 2019/0218847 | A1* | 7/2019 | Agam | G01S 17/87 |
| 2019/0327098 | A1* | 10/2019 | Hart | E05B 45/06 |

* cited by examiner

TWO-SIDED DOOR USAGE SAFETY SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to door motion detectors and more particularly pertains to a new door motion detector for preventing door related injuries.

BRIEF SUMMARY OF THE INVENTION

An embodiment of the disclosure meets the needs presented above by generally comprising a housing having a front end, a rear end, and an inner cavity. Each of the front end and the rear end have a first engagement mechanism. The housing is configured to fit through a sensor aperture in a door. A pair of motion sensors comprising a front motion sensor and a rear motion sensor is coupled within the front end and the rear end of the housing, respectively. A pair of LED indicators comprising a front LED indicator and a rear LED indicator is coupled within the front end and the rear end of the housing, respectively. A logic chip is coupled within the inner cavity and is in operational communication with the pair of motion sensors and the pair of LED indicators. A battery is coupled within the inner cavity and is in operational communication with the logic chip, the pair of LED indicators, and the pair of motion sensors. A pair of face plates comprises a front face plate and a rear face plate coupled to the front end and the rear end of the housing, respectively. Each of the front face plate and the rear face plate has a central viewing window and a second engagement mechanism. The central viewing window is transparent and exposes the LED indicator and the motion sensor, the second engagement mechanism of the front face plate and the rear face plate is selectively engageable with the first engagement mechanism of the front end and the rear end of the housing, respectively, to secure the housing into the sensor aperture of the door. The pair of motion sensors and the logic chip are configured to detect when two people are simultaneously approaching the door from either side and to illuminate the pair of LED indicators to warn the people to open the door with caution.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
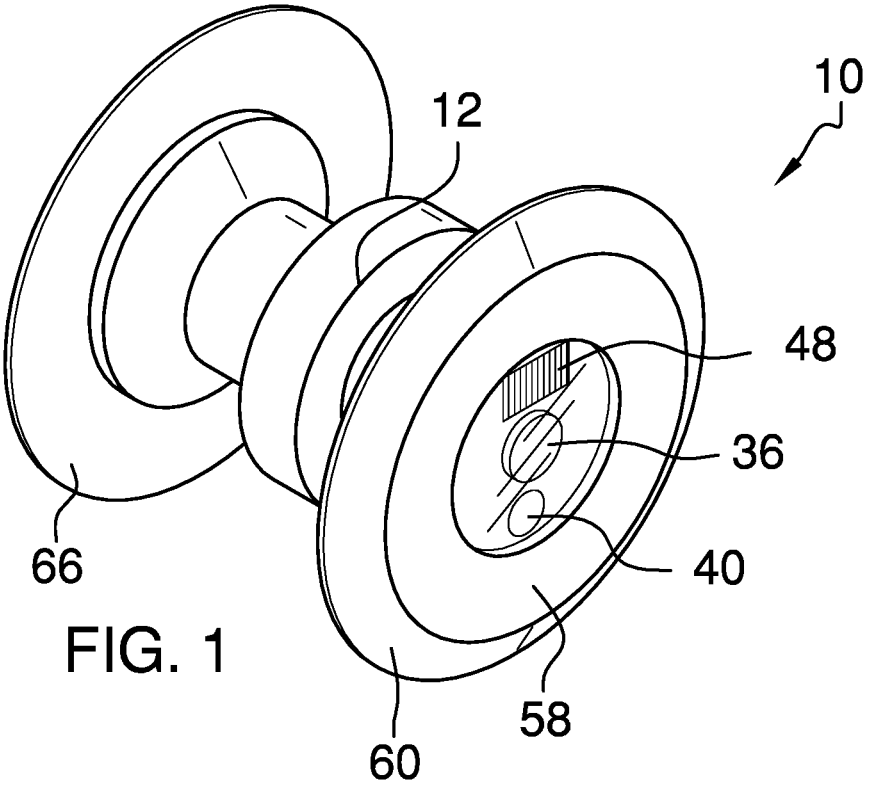
FIG. 1 is an isometric view of a two-sided door usage safety system according to an embodiment of the disclosure.
Figure 2:
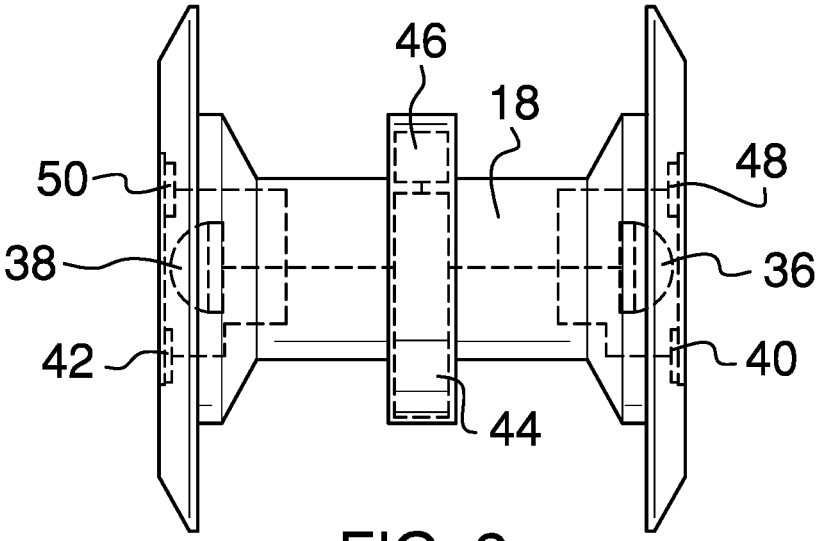
FIG. 2 is a side elevation view of an embodiment of the disclosure.
Figure 3:
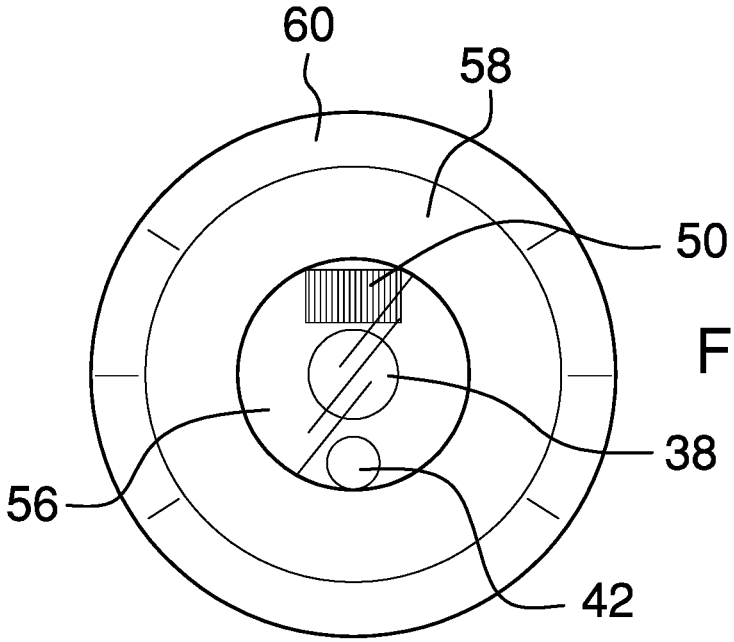
FIG. 3 is a rear elevation view of an embodiment of the disclosure.
Figure 4:
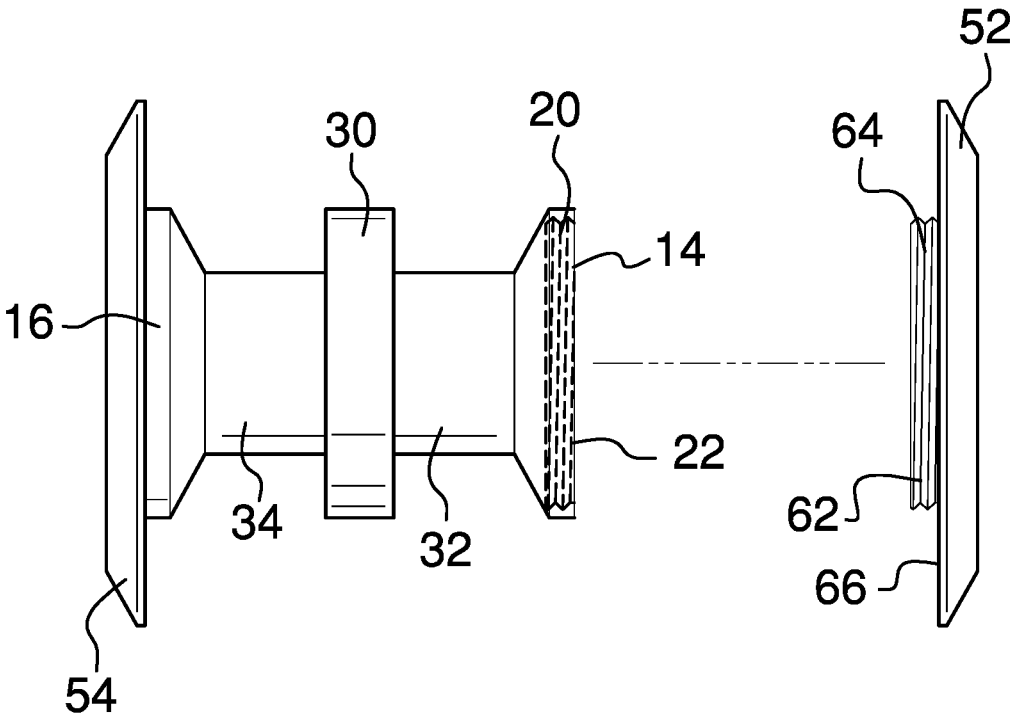
FIG. 4 is a side elevation exploded view of an embodiment of the disclosure.
Figure 5:
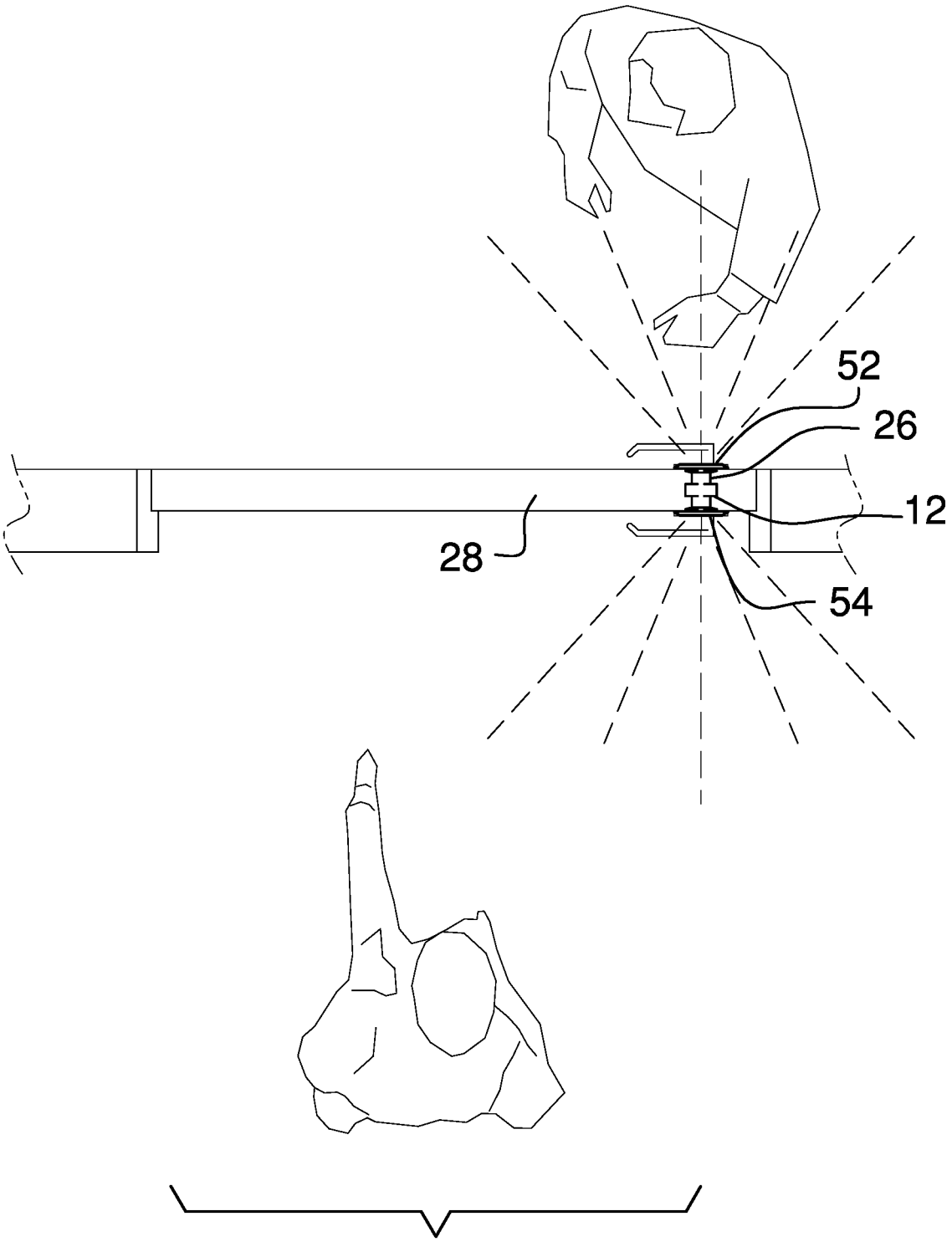
FIG. 5 is an in-use top plan view of an embodiment of the disclosure.
Figure 6:
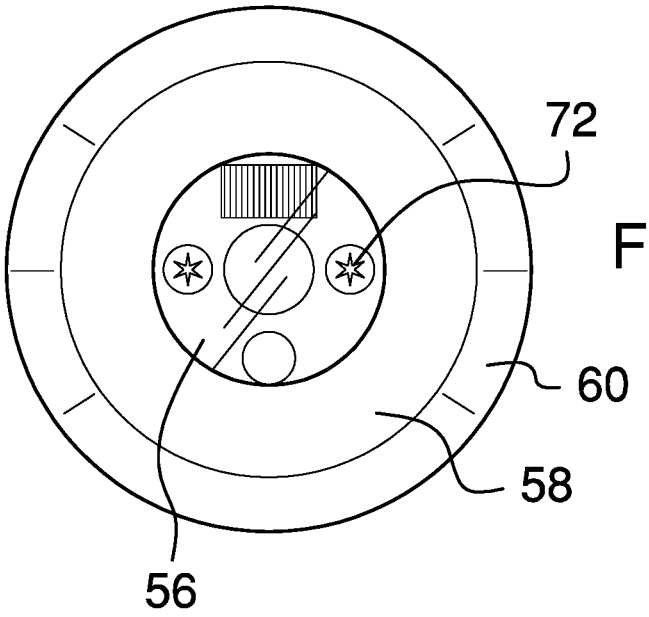
FIG. 6 is a front elevation view of an alternative embodiment of the disclosure.
Figure 7:
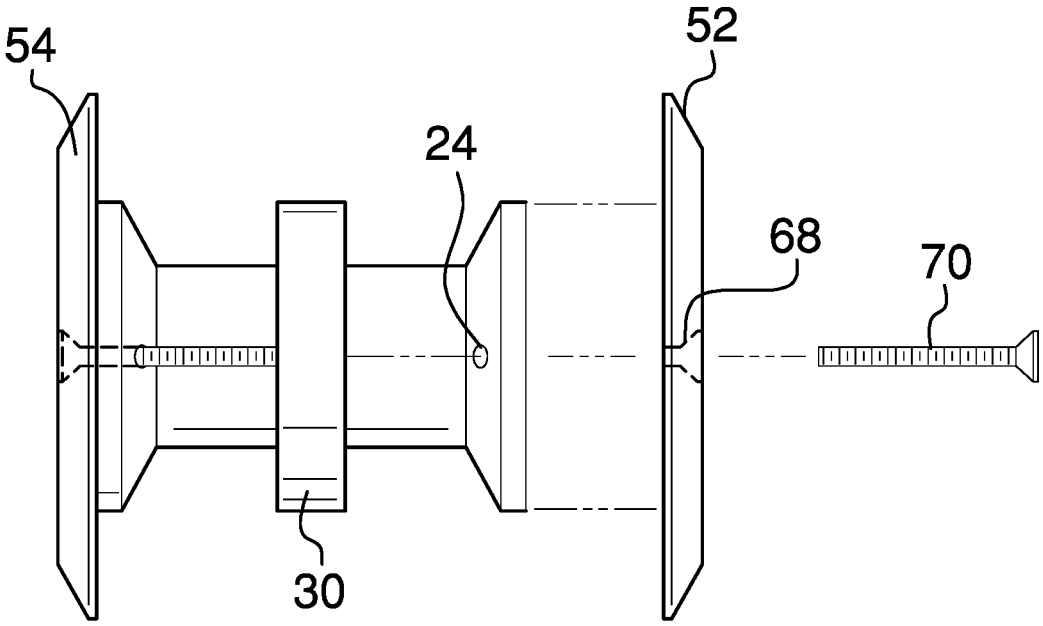
FIG. 7 is a side elevation view of an alternative embodiment of the disclosure.

With reference now to the drawings, and in particular to FIGS. 1 through 7 thereof, a new door motion detector embodying the principles and concepts of an embodiment of the disclosure and generally designated by the reference numeral 10 will be described.

As best illustrated in FIGS. 1 through 7, the two-sided door usage safety system 10 generally comprises a housing 12 having a front end 14, a rear end 16, and an inner cavity 18. Each of the front end and the rear end has a first engagement mechanism 20. The first engagement mechanism may be an inner threading 22, or alternatively may be a pair of threaded apertures 24. The housing is configured to fit through a sensor aperture 26 of a door 28. The housing 12 may comprise a cylindrical logic compartment 30, a front extension 32 extending from the logic compartment to the front end 14, and a rear extension 34 extending from the logic compartment to the rear end 16. Each of the front end and the rear end tapers out from the front extension and the rear extension, respectively.

A pair of motion sensors comprises a front motion sensor 36 and a rear motion sensor 38 coupled within the front end and the rear end of the housing, respectively. A pair of LED indicators comprises a front LED indicator 40 and a rear LED indicator 42 coupled within the front end and the rear end of the housing, respectively. Each of the pair of LED indicators may have a green light, a yellow light, and a red light. A logic chip 44 is coupled within the logic compartment 30 of the housing and is in operational communication with the pair of motion sensors and the pair of LED indicators. A battery 46 is coupled within the logic compartment and is in operational communication with the logic chip, the pair of LED indicators, and the pair of motion sensors. A pair of solar cells comprising a front solar cell 48 and a rear solar cell 50 may be coupled within the front end and the rear end of the housing, respectively. Each of the pair of solar cells is in operational communication with, and provides power to, the battery.

A pair of face plates comprises a front face plate 52 and a rear face plate 54 coupled to the front end and the rear end of the housing, respectively. Each of the front face plate and the rear face plate may be circular and have a central viewing window 56. Each of the pair of face plates has a flat section 58 surrounding the central viewing window and a tapered section 60 extending from an outer perimeter of the flat section. The central viewing window is transparent and exposes the LED indicator, the motion sensor, and the solar cell. Each of the pair of face plates has a second engagement mechanism 62. The second engagement mechanism of the front face plate and the rear face plate is selectively engageable with the first engagement mechanism of the front end and the rear end of the housing, respectively, to secure the housing into the door. The second engagement mechanism may be an outer threading 64 coupled to a door side 66 of each of the pair of face plates. The outer threading of the front face plate and the rear face plate is selectively engageable with the inner threading 22 of the front end and the rear end of the housing, respectively. The second engagement mechanism may alternatively be a pair of through apertures 68, where each of the pair of threaded apertures 24 and the pair of through apertures are configured to receive a pair of bolts 70. Each of the pair of bolts may have a star-patterned bolt head 72.

In use, the housing is installed in the sensor aperture of the door. The pair of face plates is then attached, securing the housing within the sensor aperture. The pair of motion sensors and the logic chip are configured to show the precautionary yellow light when the door is being approached by a person on the opposite side, and when two people are simultaneously approaching the door from either side to show the green light to one side and the red light to the opposite side to signal one person to stop and the other person to open the door.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A two-sided door usage safety system, the system comprising:

a housing having a front end, a rear end, and an inner cavity, each of the front end and the rear end having a first engagement mechanism, the housing being configured to fit through a sensor aperture of a door;

a pair of motion sensors coupled to the housing, the pair of motion sensors comprising a front motion sensor and a rear motion sensor, the front motion sensor and the rear motion sensor being coupled within the front end and the rear end of the housing, respectively;

a pair of LED indicators coupled to the housing, the pair of LED indicators comprising a front LED indicator and a rear LED indicator, the front LED indicator and the rear LED indicator being coupled within the front end and the rear end of the housing, respectively;

a logic chip coupled to the housing, the logic chip being coupled within the inner cavity, the logic chip being in operational communication with the pair of motion sensors and the pair of LED indicators;

a battery coupled to the housing, the battery being coupled within the inner cavity, the battery being in operational communication with the logic chip, the pair of LED indicators, and the pair of motion sensors; and a pair of face plates coupled to the housing, the pair of face plates comprising a front face plate and a rear face plate coupled to the front end and the rear end of the housing, respectively, each of the front face plate and the rear face plate having a central viewing window and a second engagement mechanism, the central viewing window being transparent and exposing the LED indicator and the motion sensor, the second engagement mechanism of the front face plate and the rear face plate being selectively engageable with the first engagement mechanism of the front end and the rear end of the housing, respectively, the pair of face plates being configured to secure the housing to the door;

wherein the pair of motion sensors and the logic chip are configured to detect when two people are simultaneously approaching the door from either side and to illuminate the pair of LED indicators to warn the people to open the door with caution.

2. The two-sided door usage safety system of claim 1 further comprising the first attachment mechanism being an inner threading and the second attachment mechanism being an outer threading, the outer threading being coupled to a door side of each of the front face plate and the rear face plate, respectively.

3. The two-sided door usage safety system of claim 1 further comprising the first attachment mechanism being a pair of threaded apertures and the second attachment mechanism being a pair of through apertures, each of the pair of threaded apertures and the pair of through apertures receiving a pair of screws.

4. The two-sided door usage safety system of claim 1 further comprising the housing comprising a cylindrical logic compartment, the logic chip and the battery being coupled within the logic compartment, a front extension extending from the logic compartment to the front end, and a rear extension extending from the logic compartment to the rear end, each of the front end and the rear end tapering out from the front extension and the rear extension, respectively.

5. The two-sided door usage safety system of claim 4 further comprising each of the pair of face plates being circular, each of the pair of face plates having a flat section surrounding the central viewing window and a tapered section extending from an outer perimeter of the flat section.

6. The two-sided door usage safety system of claim 1 further comprising a pair of solar cells, the pair of solar cells comprising a front solar cell and a rear solar cell, the front solar cell and the rear solar cell being coupled within the front end and the rear end of the housing, respectively, the central viewing window of each of the pair of face plates exposing the solar cell, each of the pair of solar cells being in operational communication with, and providing power to, the battery.

7. The two-sided door usage safety system of claim 6 further comprising each of the pair of LED indicators having a green light, a yellow light, and a red light, wherein the pair of motion sensors and the logic chip are configured to show the yellow light as a precaution when the door is being approached by a person on an opposite side, and when two people are simultaneously approaching the door from either side to show the green light to one side and the red light to the opposite side to signal to one of the two people to stop and a second of the two people to open the door.

8. A two-sided door usage safety system, the system comprising:

a housing having a front end, a rear end, and an inner cavity, each of the front end and the rear end having an inner threading, the housing being configured to fit through a sensor aperture of a door, the housing comprising a cylindrical logic compartment, a front extension extending from the logic compartment to the front end, and a rear extension extending from the logic compartment to the rear end, each of the front end and the rear end tapering out from the front extension and the rear extension, respectively;

a pair of motion sensors coupled to the housing, the pair of motion sensors comprising a front motion sensor and a rear motion sensor, the front motion sensor and the rear motion sensor being coupled within the front end and the rear end of the housing, respectively;

a pair of LED indicators coupled to the housing, the pair of LED indicators comprising a front LED indicator and a rear LED indicator, the front LED indicator and the rear LED indicator being coupled within the front end and the rear end of the housing, respectively, each of the pair of LED indicators having a green light, a yellow light, and a red light;

a logic chip coupled to the housing, the logic chip being coupled within the logic compartment, the logic chip being in operational communication with the pair of motion sensors and the pair of LED indicators;

a battery coupled to the housing, the battery being coupled within the logic compartment, the battery being in operational communication with the logic chip, the pair of LED indicators, and the pair of motion sensors;

a pair of solar cells, the pair of solar cells comprising a front solar cell and a rear solar cell, the front solar cell and the rear solar cell being coupled within the front end and the rear end of the housing, respectively, each of the pair of solar cells being in operational communication with, and providing power to, the battery; and a pair of face plates coupled to the housing, the pair of face plates comprising a front face plate and a rear face plate coupled to the front end and the rear end of the housing, respectively, each of the front face plate and the rear face plate having a central viewing window, each of the pair of face plates being circular, each of the pair of face plates having a flat section surrounding the central viewing window and a tapered section extending from an outer perimeter of the flat section, each of the pair of face plates having an outer threading coupled to a door side, the central viewing window being transparent and exposing the LED indicator, the motion sensor, and the solar cell, the outer threading of the front face plate and the rear face plate being selectively engageable with the inner threading of the front end and the rear end of the housing, respectively, the pair of face plates being configured to secure the housing to the door;

wherein the pair of motion sensors and the logic chip are configured to show the precautionary yellow light when the door is being approached by a person on an opposite side, and when two people are simultaneously approaching the door from either side to show the green light to one side and the red light to the opposite side to signal to one of the two people to stop and a second of the two people to open the door.

9. A door and two-sided door usage safety system combination comprising:

a door having a front side and a rear side, the front side having a sensor aperture extending through to the rear side;

a housing having a front end, a rear end, and an inner cavity, each of the front end and the rear end having a first engagement mechanism, the housing being coupled within the sensor aperture of the door;

a pair of motion sensors coupled to the housing, the pair of motion sensors comprising a front motion sensor and a rear motion sensor, the front motion sensor and the rear motion sensor being coupled within the front end and the rear end of the housing, respectively;

a pair of LED indicators coupled to the housing, the pair of LED indicators comprising a front LED indicator and a rear LED indicator, the front LED indicator and the rear LED indicator being coupled within the front end and the rear end of the housing, respectively;

a logic chip coupled to the housing, the logic chip being coupled within the inner cavity, the logic chip being in operational communication with the pair of motion sensors and the pair of LED indicators;

a battery coupled to the housing, the battery being coupled within the inner cavity, the battery being in operational communication with the logic chip, the pair of LED indicators, and the pair of motion sensors; and a pair of face plates coupled to the housing, the pair of face plates comprising a front face plate and a rear face plate coupled to the front end and the rear end of the housing, respectively, each of the front face plate and the rear face plate having a central viewing window and a second engagement mechanism, the central viewing window being transparent and exposing the LED indicator and the motion sensor, the second engagement mechanism of the front face plate and the rear face plate being selectively engageable with the first engagement mechanism of the front end and the rear end of the housing, respectively, the pair of face plates securing the housing within the sensor aperture of the door;

wherein the pair of motion sensors and the logic chip are configured to detect when two people are simultaneously approaching the door from either side and to illuminate the pair of LED indicators to warn the people to open the door with caution.

* * * * *